US009777358B2

(12) United States Patent
Ichimiya et al.

(10) Patent No.: US 9,777,358 B2
(45) Date of Patent: Oct. 3, 2017

(54) THICK-WALLED, HIGH TENSILE STRENGTH STEEL WITH EXCELLENT CTOD CHARACTERISTICS OF THE WELD HEAT-AFFECTED ZONE, AND MANUFACTURING METHOD THEREOF

(71) Applicant: JFE STEEL CORPORATION, Tokyo (JP)

(72) Inventors: Katsuyuki Ichimiya, Tokyo (JP); Masao Yuga, Tokyo (JP); Kenji Hayashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 336 days.

(21) Appl. No.: 14/416,960

(22) PCT Filed: Sep. 4, 2013

(86) PCT No.: PCT/JP2013/005241
§ 371 (c)(1),
(2) Date: Jan. 23, 2015

(87) PCT Pub. No.: WO2014/038200
PCT Pub. Date: Mar. 13, 2014

(65) Prior Publication Data

US 2015/0203945 A1 Jul. 23, 2015

(30) Foreign Application Priority Data

Sep. 6, 2012 (JP) ..... 2012-195718

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/16*** | (2006.01) |
| ***C22C 38/14*** | (2006.01) |
| ***C22C 38/12*** | (2006.01) |
| ***C22C 38/38*** | (2006.01) |
| ***C22C 38/58*** | (2006.01) |
| ***C21D 9/46*** | (2006.01) |
| ***C21D 8/02*** | (2006.01) |
| ***C22C 38/00*** | (2006.01) |
| ***C22C 38/08*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |
| ***C21D 1/20*** | (2006.01) |
| ***C21D 6/00*** | (2006.01) |

(52) U.S. Cl.

CPC ..... *C22C 38/58* (2013.01); *C21D 1/20* (2013.01); *C21D 6/001* (2013.01); *C21D 6/004* (2013.01); *C21D 6/005* (2013.01); *C21D 6/008* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/46* (2013.01); *C22C 38/48* (2013.01); *C22C 38/50* (2013.01); *C21D 2211/002* (2013.01); *C21D 2211/004* (2013.01); *C21D 2211/005* (2013.01)

(58) Field of Classification Search
None
See application file for complete search history.

(56) References Cited

U.S. PATENT DOCUMENTS

2015/0075682 A1* 3/2015 Yuga ..... C22C 38/14 148/645

FOREIGN PATENT DOCUMENTS

| | | | |
|---|---|---|---|
| CN | 102124133 | A | 7/2011 |
| EP | 2272994 | A1 | 1/2011 |
| JP | 60-184663 | U | 12/1985 |
| JP | 6-220577 | A | 8/1994 |
| JP | 6-240406 | A | 8/1994 |
| JP | H08-144008 | A | 6/1996 |
| JP | H08-311549 | A | 11/1996 |
| JP | H08-311550 | A | 11/1996 |
| JP | 11-229077 | A | 8/1999 |
| JP | 11-241119 | A | 9/1999 |
| JP | 3045856 | B2 | 5/2000 |
| JP | 3-053367 | B2 | 6/2000 |
| JP | 2002-285279 | A | 10/2002 |
| JP | 3697202 | B2 | 9/2005 |
| JP | 2009-263777 | A | 11/2009 |
| JP | 4432905 | B2 | 3/2010 |
| JP | 2010-100903 | A | 5/2010 |

OTHER PUBLICATIONS

Dec. 17, 2015 Search Report issued in European Application No. 13834774.5.
Aug. 22, 2016 Office Action issued in Chinese Patent Application No. 201380045901.6.
Nov. 26, 2013 International Search Report issued in PCT/JP2013/005241.
Mar. 2, 2017 Office Action issued in Chinese Patent Application No. 201380045901.6.
Jun. 23, 2015 Office Action issued in Japanese Patent Application No. 2014-534198.

* cited by examiner

*Primary Examiner* — Deborah Yee
(74) *Attorney, Agent, or Firm* — Oliff PLC

(57) ABSTRACT

A thick-walled high-strength steel plate with excellent low-temperature toughness (Charpy impact and CTOD properties of a weld bond) in a multilayer weld zone, and a method for manufacturing the steel plate.

14 Claims, No Drawings

THICK-WALLED, HIGH TENSILE STRENGTH STEEL WITH EXCELLENT CTOD CHARACTERISTICS OF THE WELD HEAT-AFFECTED ZONE, AND MANUFACTURING METHOD THEREOF

TECHNICAL FIELD

This application relates to a high-strength steel plate which is used for steel structures such as ships, marine structures, pressure vessels, and penstocks and to a method for manufacturing the steel plate. In particular, this application relates to a heavy wall thickness high-strength steel plate having a yield stress (YS) of 420 MPa or more which is excellent not only in terms of the strength and toughness of a base metal but also in terms of the low-temperature toughness (CTOD property) of a multilayer weld zone and to a method for manufacturing the steel plate.

BACKGROUND

Steels which are used for ships, marine structures, and pressure vessels are joined by performing welding so as to form the specified final shapes of the structures. Therefore, it is needless to say that such steels are required to have high strength and excellent toughness for a base metal from the viewpoint of the safety of the structures, and in addition, such steels are required to be excellent in terms of the toughness of a welded joint (weld metal) and a heat-affected zone.

Absorbed energy in a Charpy impact test has mainly been used as an evaluation standard for evaluating the toughness of steel in the past. Nowadays, a Crack Tip Opening Displacement Test (hereinafter, referred to as a CTOD test) is often used in order to increase reliability of the evaluation. In this test, resistance to the occurrence of brittle fracture is evaluated by performing a three-point bend test on a test piece which has been given a fatigue precrack in a region whose toughness is to be evaluated in order to determine the amount of opening (the amount of plastic deformation) of the crack immediately before a fracture occurs.

Since a fatigue precrack is used in a CTOD test, the toughness of a very small region is evaluated. Therefore, a CTOD test may indicate low toughness in the case where a local embrittlement region is present, even if a Charpy impact test indicates good toughness.

A local embrittlement region tends to be formed in a heat-affected zone (hereinafter, also referred to as a HAZ) which is subjected to a complex thermal history due to multilayer weld being performed on, for example, a heavy wall thickness steel, and a bond (the boundary between a weld metal and a base metal) or a region in a bond which is reheated in a temperature range in which a dual phase is formed (a region in which there is an increase in grain diameter in the first cycle of welding, which is reheated in a temperature range in which a ferrite-austenite dual phase is formed in the subsequent welding passes, and which is, hereinafter, referred to as a region reheated in a dual-phase temperature range) becomes a local embrittlement region.

Since a bond is exposed to a high temperature just below the melting point, there is an increase in austenite grain diameter. Therefore, the austenite phase tends to transform into an upper bainite phase having low toughness when cooling is subsequently performed, which results in a decrease in the toughness of a matrix. In addition, since an embrittlement structure such as a Widmannstaetten structure or a martensite-austenite constituent (MA) tends to be formed in a bond, there is a further decrease in toughness.

In order to increase the toughness of a heat-affected zone, for example, a technique in which TiN is finely dispersed in steel in order to suppress an increase in the austenite grain diameter or in order to utilize TiN as a ferrite nucleation site has been put into practice. However, since there is a case where a bond is heated up to a temperature in a range in which TiN is dissolved, the stricter the requirement for low-temperature toughness, the less likely the effects described above are to be realized.

On the other hand, Patent Literature 1 and Patent Literature 2 disclose a technique in which the toughness of a weld zone is increased by adding a combination of a rare earth metal (REM) and Ti and by dispersing fine particles in steel in order to suppress an increase in austenite grain diameter.

In addition, a technique in which a Ti oxide is dispersed, a technique in which the ferrite nucleation capability of BN and oxide dispersion are combined, and a technique in which toughness is increased by further adding Ca and REM in order to control the form of sulfides are proposed in order to increase toughness.

However, these techniques, which are intended for a steel material having comparatively low strength and small alloy content, cannot be applied to a steel material having comparatively high strength and high alloy content, because a HAZ structure including no ferrite phase is formed.

Therefore, as an example of a technique with which a ferrite phase tends to be formed in a heat-affected zone, Patent Literature 3 discloses mainly a technique in which Mn content is increased to 2 mass % or more. However, since Mn tends to be segregated in the central part of a slab in the case of a continuously cast slab, there is an increase in the hardness of a center segregation part not only in a base metal but also in a heat-affected zone, and the region becomes the origin of a fracture, which results in a decrease in the toughness of the base metal and the HAZ.

On the other hand, in a region reheated in a dual-phase temperature range, since carbon is concentrated in a region composed of a reverse-transformed austenite phase formed by performing heating in a temperature range in which a dual phase is formed, a brittle bainite structure including a martensite-austenite constituent is formed, which results in a decrease in toughness. Therefore, techniques in which toughness is increased by decreasing C content and Si content in steel in order to suppress the formation of a martensite-austenite constituent and in which sufficient strength for a base metal is achieved by adding Cu are disclosed (for example, Patent Literature 4 and Patent Literature 5). These are methods in which strength is increased through precipitation strengthening using Cu. Patent Literature 4 uses a method in which a cooling rate after rolling has been performed is controlled to be 0.1° C./s or less so that Cu particles are precipitated in the cooling process. There is a problem to be solved regarding manufacture stability in the case of the method according to Patent Literature 4. In addition, in the case of Patent Literature 5, a decrease in toughness due to an increase in the grain diameter of AlN and the negative effect of solid solute N is suppressed by controlling a N/Al ratio to be 0.3 to 3.0. However, the negative effect of solid solute N can be suppressed more easily using Ti.

CITATION LIST

Patent Literature

PTL 1: Japanese Examined Patent Application Publication No. 3-053367

PTL 2: Japanese Unexamined Patent Application Publication No. 60-184663

PTL 3: Japanese Patent No. 3697202

PTL 4: Japanese Patent No. 3045856

PTL 5: Japanese Patent No. 4432905

SUMMARY

Technical Problem

Nowadays, due to an increase in the size of steel structures such as ships, marine structures, pressure vessels, and penstocks, steel materials which are used for these steel structures are required to have high strength more than ever. Since steel materials which are used for these steel structures have a large thickness of, for example, 35 mm or more in many cases, a chemical composition having a high alloy content is effective for achieving a yield strength of 420 MPa or more. However, as described above, in the case of a high-strength steel material having a high alloy content, it cannot be said that sufficient investigations have been conducted in order to increase the toughness of a bond or a region reheated in a dual-phase temperature range.

Therefore, an object of the present disclosure is to provide a high-strength steel plate which has a yield stress (YS) of 420 MPa or more and excellent low-temperature toughness (CTOD property) of a heat-affected zone in a multilayer weld zone and which can be suitably used for steel structures such as ships, marine structures, pressure vessels, and penstocks and to provide a method for manufacturing the steel plate.

Solution to Problem

The present inventors diligently conducted investigations in order to solve the problems described above and designed a specific chemical composition taking into consideration the technological thought described below.

1. Since a CTOD property is evaluated using a test piece including the whole thickness of a steel plate, a center segregation part becomes the origin of a fraction. Therefore, in order to improve the CTOD property of a heat-affected zone, an increase in the hardness of a center segregation part is suppressed by appropriately controlling the amount of chemical elements which tend to be concentrated in the form of center segregation in a steel plate. Since the degrees of concentration of C, Mn, P, Ni, and Nb are higher than those of other chemical elements in the central part of a slab which is the last part to be solidified in the solidification process of molten steel, an increase in the hardness of central segregation is suppressed by controlling the amounts of these chemical elements added using the hardness of a center segregation part as an indicator.

2. In order to increase the toughness of a heat-affected zone, an increase in the austenite grain diameter in the vicinity of a weld bond is suppressed by effectively utilizing TiN. TiN can be uniformly and finely dispersed in steel by appropriately controlling the value of Ti/N.

3. Crystallization of a Ca compound (CaS) which is added in order to control the shape of sulfides is utilized to increase the toughness of a heat-affected zone. Since CaS crystallizes at a lower temperature than oxides, CaS can be uniformly and finely dispersed. By controlling the amount of CaS added and oxygen content dissolved in molten steel when CaS is added to be within appropriate ranges, a sufficient amount of solid solute S is retained even after CaS has crystallized, and thus a complex sulfide is formed as a result of MnS being precipitated on the surface of CaS. Since a Mn depletion zone is formed around this MnS, ferrite transformation is promoted more than usual.

That is to say, according to embodiments:

1. A heavy wall thickness high-strength steel plate with an excellent CTOD property of a heat-affected zone, the steel plate having a chemical composition containing, by mass %, C: 0.020% or more and 0.080% or less, Si: 0.01% or more and 0.35% or less, Mn: 1.20% or more and 2.30% or less, P: 0.008% or less, S: 0.0035% or less, Al: 0.010% or more and 0.060% or less, Cu: 0.70% or more and 1.50% or less, Ni: 0.40% or more and 2.00% or less, Nb: 0.005% or more and 0.040% or less, Ti: 0.005% or more and 0.025% or less, N: 0.0020% or more and 0.0050% or less, O: 0.0030% or less, and the balance being Fe and inevitable impurities, in which Ceq which is defined by relational expression (1) is 0.52% or less, in which Ti/N is 1.50 or more and 4.00 or less, in which relational expression (2) is satisfied, and in which the hardness of a center segregation part satisfies relational expression (3):

$$Ceq=[C]+[Mn]/6+([Cu]+[Ni])/15+([Cr]+[Mo]+[V])/5 \quad (1),$$

$$5.5[C]^{4/3}+15[P]+0.90[Mn]+0.12[Ni]+7.9[Nb]^{1/2}+0.53[Mo]\leq 3.50 \quad (2),$$

where symbol [M] represents the content (mass %) of the chemical element represented by symbol M, $$H_{Vmax}/H_{Vave}\leq 1.35+0.006/[C]-t/500 \quad (3),$$

where $H_{Vmax}$ represents a maximum value of the Vickers hardness of a center segregation part, $H_{Vave}$ represents an average value of the Vickers hardness of the portions other than portions within ¼ of the thickness from the upper and lower surfaces of the steel plate and the center segregation part, [C] represents C content (mass %), and t represents the thickness of the steel plate (mm).

2. The heavy wall thickness high-strength steel plate with an excellent CTOD property of a heat-affected zone according to item 1, the steel plate having the chemical composition further containing, by mass %, one, two, or more selected from among Cr: 0.10% or more and 1.00% or less, Mo: 0.05% or more and 0.50% or less, and V: 0.005% or more and 0.050% or less.

3. The heavy wall thickness high-strength steel plate with an excellent CTOD property of a heat-affected zone according to item 1 or 2, the steel plate having the chemical composition further containing, by mass %, Ca: 0.0005% or more and 0.0050% or less, in which relational expression (4) is satisfied.

$$0<\{[Ca]-(0.18+130\times[Ca])\times[O]\}/1.25/[S]<1.00 \quad (4),$$

where symbol [M] represents the content (mass %) of the chemical element represented by symbol M.

4. A method for manufacturing a heavy wall thickness high-strength steel plate with an excellent CTOD property of a heat-affected zone, the method including heating steel having the chemical composition according to any one of items 1 to 3 at a temperature of 1030° C. or higher and 1200° C. or lower, performing hot rolling on the heated steel such that the cumulative rolling reduction in a temperature range of 950° C. or higher is 30% or more and that the cumulative rolling reduction in a temperature range of lower than 950° C. is 30% or more and 70% or less, performing accelerated cooling on the hot-rolled steel plate down to a temperature of 600° C. or lower at a cooling rate of 1.0° C./s or more, and performing a tempering treatment on the cooled steel plate at a temperature of 450° C. or higher and 650° C. or lower.

Advantageous Effects

According to embodiments, a heavy wall thickness high-strength steel plate which has a yield stress (YS) of 420 MPa or more and an excellent CTOD property of a multilayer weld zone and which is suitably used for large-size steel structures such as marine structures and a method for manufacturing the steel plate are obtained, which results in a significant effect in industry.

DETAILED DESCRIPTION OF EMBODIMENTS

In embodiments, a chemical composition and hardness distribution in the thickness direction are specified.

1. Chemical composition

The reason for limitations on the chemical composition will be described. In the description, % represents mass %.

C: 0.020% or more and 0.080% or less

C is a chemical element which is necessary to achieve sufficient strength for the base metal of a high-strength steel plate. In the case where the C content is less than 0.020%, there is a decrease in hardenability. In addition, when sufficient strength is intended to be achieved for a base metal in the case where the C content is less than 0.020%, it is necessary to add large amounts of chemical elements such as Cu, Ni, Cr, and Mo which increase hardenability in order to achieve sufficient strength. Accordingly, there is an increase in cost in the case where the C content is less than 0.020%. In addition, in the case where the C content is more than 0.080%, there is a decrease in weldability and there is a significant decrease in the toughness of a weld zone. Therefore, the C content is set to be 0.020% or more and 0.080% or less, preferably 0.020% or more and 0.070% or less, more preferably 0.020% or more and 0.060% or less, or most preferably 0.020% or more and less than 0.050%.

Si: 0.01% or more and 0.35% or less

Si is a component which is added as a deoxidizing agent in order to achieve sufficient strength for a base metal. Therefore, the Si content is set to be 0.01% or more. However, in the case where the Si content is more than 0.35%, there is a decrease in weldability, and in addition, there is also a decrease in the toughness of a welded joint. It is necessary that the Si content be 0.01% or more and 0.35% or less, preferably 0.23% or less.

Mn: 1.20% or more and 2.30% or less

Mn is a chemical element which is used to achieve sufficient strength for a base metal and a welded joint, and the Mn content is set to be 1.20% or more. However, in the case where the Mn content is more than 2.30%, there is a decrease in weldability, and in addition, there is a decrease in the toughness of a base metal and a welded joint due to hardenability becoming excessively large. Therefore, the Mn content is set to be 1.20% or more and 2.30% or less, preferably more than 1.50% and 2.30% or less.

P: 0.008% or less

P, which is an impurity element, decreases the toughness of a base metal and a weld zone. In particular, in the case where the P content is more than 0.008% in a weld zone, there is a significant decrease in a CTOD property. Therefore, the P content is set to be 0.008% or less, preferably 0.005% or less, or more preferably 0.004% or less. In order to decrease the P content like this, it is necessary to perform an operation for purposefully decreasing the P content, such as one using light reduction rolling performed in a continuous casting process or electromagnetic stirring performed on the downstream side of a continuous casting machine, for example.

S: 0.0035% or less

S is an impurity which is inevitably mixed in. In the case where the S content is more than 0.0035%, there is a decrease in the toughness of a base metal and a weld zone. Therefore, the S content is set to be 0.0035% or less, preferably 0.0030% or less.

Al: 0.010% or more and 0.060% or less

Al is a chemical element which is added in order to dioxidize molten steel, and it is necessary that the Al content be 0.010% or more. On the other hand, in the case where the Al content is more than 0.060%, there is a decrease in the toughness of a base metal and a weld zone, and in addition, since Al is mixed into a weld metal through dilution when welding is performed, there is a decrease in toughness. Therefore, the Al content is set to be 0.060% or less, preferably 0.017% or more and 0.055% or less, more preferably more than 0.015% and 0.055% or less, or most preferably more than 0.020% and 0.055% or less. Here, in embodiments, the Al content is specified in terms of acid-soluble Al (also referred to as, for example, Sol.Al).

Cu: 0.70% or more and 1.50% or less

Cu can increase the strength of a base metal as a result of being finely precipitated. In order to realize this effect, the Cu content is set to be 0.70% or more. On the other hand, since there is a decrease in hot ductility in the case where the Cu content is more than 1.50%, the Cu content is limited to 1.50% or less, preferably 0.80% or more and 1.30% or less.

Ni: 0.40% or more and 2.00% or less

Ni is a chemical element which is effective for increasing the strength and toughness of steel and for improving a CTOD property of a weld zone. In order to realize these effects, it is necessary that the Ni content be 0.40% or more. However, Ni is an expensive chemical element, and defects tend to occur on the surface of a slab when casting is performed in the case where the Ni content is excessively large. Therefore, the upper limit of the Ni content is set to be 2.00%.

Nb: 0.005% or more and 0.040% or less

Since Nb forms a non-recrystallization region in a low temperature range for forming an austenite phase, when performing rolling in this temperature range, Nb contributes to a decrease in the grain diameter of the microstructure of a base metal and to an increase in toughness. In addition, in the case where Nb is added, an effect of precipitation strengthening can be realized by performing air cooling after rolling and cooling have been performed or by performing a tempering treatment thereafter. In order to realize these effects, it is necessary that the Nb content be 0.005% or more, preferably more than 0.013%. However, since there is a decrease in toughness in the case where the Nb content is more than 0.040%, the upper limit of the Nb content is set to be 0.040%, preferably 0.035%.

Ti: 0.005% or more and 0.025% or less

Ti is precipitated in the form of TiN when molten steel is solidified and contributes to an increase in the toughness of a weld zone by suppressing an increase in the austenite grain diameter in a weld zone. However, there is only a small effect in the case where the Ti content is less than 0.005%, and on the other hand, an effect of increasing the toughness of a base metal and a weld zone cannot be realized in the case where the Ti content is more than 0.025% due to an excessive increase in the grain diameter of TiN. Therefore, the Ti content is set to be 0.005% or more and 0.025% or less.

N: 0.0020% or more and 0.0050% or less

N increases the toughness of a base metal by decreasing the crystal grain diameter as a result of forming precipitates in combination with Ti and Al. In addition, N is a chemical element which is necessary to form TiN which suppresses an increase in the grain diameter in the microstructure of a weld zone. In order to realize these effects, it is necessary that the N content be 0.0020% or more. On the other hand, since there is a significant decrease in the toughness of a base metal and a weld zone due to solid solute N in the case where the N content is more than 0.0050%, the upper limit of the N content is set to be 0.0050%.

O: 0.0030% or less

Since there is a decrease in the toughness of a base metal in the case where the O content is more than 0.0030%, the O content is set to be 0.0030% or less, preferably 0.0020% or less.

Ceq: 0.520% or less

In the case where Ceq which is defined by relational expression (1) is more than 0.520%, there is a decrease in weldability and the toughness of a weld zone, and therefore, Ceq is set to be 0.520% or less, preferably 0.500% or less.

$$Ceq=[C]+[Mn]/6+([Cu]+[Ni])/15+([Cr]+[Mo]+[V])5 \quad (1),$$

where symbol [M] represents the content (mass %) of the chemical element represented by symbol M, and where symbol [M] is assigned a value of 0 in the case where the chemical element represented by symbol M is not added.

Ti/N: 1.50 or more and 4.00 or less

In the case where Ti/N is less than 1.50, there is a decrease in the amount of TiN formed, and therefore, solid solute N which is retained without forming TiN decreases the toughness of a weld zone. In addition, in the case where Ti/N is more than 4.00, there is a decrease in the toughness of a weld zone due to an increase in the grain diameter of TiN. Therefore, Ti/N is set to be 1.50 or more and 4.00 or less, preferably 1.80 or more and 3.50 or less. In the expression Ti/N, symbols Ti and N respectively represent the contents (mass %) of the corresponding chemical elements.

$$5.5[C]^{4/3}+15[P]+0.90[Mn]+0.12[Ni]+7.9[Nb]^{1/2}+0.53[Mo]\leq 3.50 \quad (2),$$

where symbol [M] represents the content (mass %) of the chemical element represented by symbol M.

The left-hand side value of relational expression (2) is an index of the hardness of a center segregation part which is composed of components which tend to be concentrated in the center segregation part, and will be referred to as a Ceq* value in the description below. Since a CTOD test is performed using a test piece including the whole thickness of a steel plate, the test piece includes a center segregation part. Therefore, in the case where the components are significantly concentrated in the center segregation part, a hardened region is formed in a heat-affected zone, and it is not possible to achieve a good CTOD property. By controlling a Ceq* value to be within an appropriate range, it is possible to suppress an excessive increase in hardness in a center segregation part, and an excellent CTOD property can be obtained even in the weld zone of a steel material having a large thickness. The appropriate range of a Ceq* value was empirically obtained, and, since there is a decrease in CTOD property in the case where a Ceq* value is more than 3.50, the Ceq* value is set to be 3.50 or less, preferably 3.20 or less.

Although the basic chemical composition of the heavy wall thickness high-strength steel plate according to embodiments is as described above and the balance consists of Fe and inevitable impurities, the heavy wall thickness high-strength steel plate may further contain one, two or more selected from among Cr: 0.10% or more and 1.00% or less, Mo: 0.05% or more and 0.50% or less, and V: 0.005% or more and 0.050% or less in order to further improve properties.

Cr: 0.10% or more and 1.00% or less

Cr is a chemical element which is effective for increasing the strength of a base metal, and it is preferable that the Cr content be 0.10% or more in order to realize this effect. However, in the case where the Cr content is excessively large, there is a negative effect on toughness, and therefore, it is preferable that the Cr content be 0.10% or more and 1.00% or less in the case where Cr is added, more preferably 0.20% or more and 0.80% or less.

Mo: 0.05% or more and 0.50% or less

Mo is a chemical element which is effective for increasing the strength of a base metal, and it is preferable that the Mo content be 0.05% or more in order to realize this effect. However, in the case where the Mo content is excessively large, there is a negative effect on toughness, and therefore, it is preferable that the Mo content be 0.05% or more and 0.50% or less in the case where Mo is added, more preferably 0.08% or more and 0.40% or less.

V: 0.005% or more and 0.050% or less

V is a chemical element which is effective for increasing the strength and toughness of a base metal in the case where the V content is 0.005% or more. Since there is a decrease in toughness in the case where the V content is more than 0.050%, it is preferable that the V content be 0.005% or more and 0.050% or less in the case where V is added.

In addition to the components described above, the chemical composition according to embodiments may further contain Ca: 0.0005% or more and 0.0050% or less.

Ca: 0.0005% or more and 0.0050% or less

Ca is a chemical element which increases toughness by fixing S. In order to realize this effect, it is necessary that the Ca content be at least 0.0005%. However, in the case where the Ca content is more than 0.0050%, since the effect described above corresponding to the amount of Ca added becomes saturated, it is preferable that the Ca content be 0.0005% or more and 0.0050% or less.

$$0<\{[Ca]-(0.18+130\times[Ca])\times[O]\}/1.25/[S]<1.00 \quad (4),$$

where symbol [M] represents the content (mass %) of the chemical element represented by symbol M.

$\{[Ca]-(0.18+130\times[Ca])\times[O]\}/1.25[S]$ is a value which indicates a ratio of the atomic concentration of Ca which is effective for controlling the form of sulfides to the atomic concentration of S and is also referred to as an ACR (Atomic Concentration Ratio). Using this value, it is possible to estimate the form of sulfides, and the range of an ACR is specified in order to finely disperse ferrite transformation nucleation sites, that is, CaS which does not dissolve even at a high temperature. [Ca], [S], and [O] respectively represent the content (mass %) of the corresponding chemical elements in relational expression (4).

In the case where the ACR value is 0 or less, CaS does not crystallize. Therefore, since S is precipitated in the form of MnS only, a ferrite nucleation site cannot be formed in a heat-affected zone. In addition, since MnS which has been solely precipitated is elongated when rolling is performed, there is a decrease in the toughness of a base metal.

On the other hand, in the case where the ACR value is 1.0 or more, S is completely fixed by Ca, and MnS which functions as a ferrite nucleation site is not precipitated on CaS. Therefore, complex sulfides cannot realize the fine dispersion of ferrite nucleation sites, which results in an effect of an increase in toughness not being realized.

In the case where the ACR value is more than 0 and less than 1.0, since a complex sulfide is formed as a result of MnS being precipitated on CaS, the complex sulfide can effectively function as a ferrite nucleation site. Here, it is preferable that the ACR value be 0.20 to 0.80.

2. Hardness Distribution $$H_{Vmax}/H_{Vave} \leq 1.35+0.006/[C]-t/500 \quad (3)$$

$H_{Vmax}$ represents a maximum value of the Vickers hardness of a center segregation part, $H_{Vave}$ represents an average value of the Vickers hardness of the portions other than portions within ¼ of the thickness from the upper and lower surfaces of the steel plate and the center segregation part, [C] represents C content (mass %), and t represents the thickness of the steel plate (mm). $H_{Vmax}/H_{Vave}$ is a dimensionless parameter which indicates the hardness of a center segregation part, and, since there is a decrease in a CTOD value in the case where $H_{Vmax}/H_{Vave}$ is more than a value derived by 1.35+0.006/[C]−t/500, $H_{Vmax}/H_{Vave}$ is set to be equal to or less than 1.35+0.006/[C]−t/500, preferably equal to or less than 1.25+0.006/[C]−t/500.

$H_{Vmax}$ is the hardness of a center segregation part and is defined as the maximum value among the values obtained by determining the hardness at intervals of 0.25 mm in the thickness direction in an area including the center segregation part having a length of (thickness/40) mm in the thickness direction using a Vickers hardness testing machine (with a load of 10 kgf). In addition, $H_{Vave}$ is an average value of hardness and is defined as the average value of the values obtained by determining hardness at certain intervals (for example, 1 to 2 mm) in the thickness direction in an area between a position located at ¼ of the thickness on the upper surface side and a position located at ¼ of the thickness on the lower surface side excluding a center segregation part using a Vickers hardness testing machine with a load of 98 N (10 kgf).

The condition expressed by relational expression (3) may be satisfied without difficulty by selecting casting conditions in order to decrease the degree of center segregation, by controlling the contents of chemical elements, which tend to occur segregation, to be as small as possible, and, regarding rolling conditions, by performing heating for rolling at a low temperature and performing finishing rolling at a low temperature in order to prevent the grain diameter of a bainite structure from increasing in the central part of the thickness.

Subsequently, the microstructure of the heavy wall thickness high-strength steel plate according to embodiments will be described. The microstructure of the heavy wall thickness high-strength steel plate according to embodiments mainly includes 10 vol % or more of an acicular ferrite phase, 5 vol % or more and 50 vol % or less of a bainite phase, and 10 vol % or less of a polygonal ferrite phase.

Acicular ferrite phase: 10 vol % or more

It is preferable that the amount of an acicular ferrite phase be 10 vol % or more, because sufficient strength and toughness for a base metal can be achieved.

Bainite phase: 5 vol % or more and 50 vol % or less

It is preferable that the amount of a bainite phase be 5 vol % or more, because high strength can be achieved. It is preferable that the amount of a bainite phase be 50 vol % or less, because sufficient toughness for a base metal can be achieved.

Polygonal ferrite phase: 10 vol % or less

It is preferable that the amount of a polygonal ferrite phase be 10 vol % or less, because high strength can be achieved.

Examples of microstructures other than those described above include a martensite-austenite constituent, a perlite phase, and a cementite phase, and it is preferable that the total amount of these microstructures be 10 vol % or less.

In addition, the amount of each of the microstructures described above is defined as the amount (vol %) determined by performing image analysis on a photograph taken at a position located at ¼ of the thickness of a heavy wall thickness high-strength steel plate using a scanning electron microscope.

It is preferable that the steel plate according to embodiments be manufactured using the manufacturing method described below. When using steel having the chemical composition described above as a raw material and manufacturing the steel plate using the preferable manufacturing method described below, there is a tendency for relational expression (3) to be satisfied.

Molten steel having a chemical composition within the range according to embodiments is smelted using a common method such as one using a converter furnace, an electric furnace, or a vacuum melting furnace, the smelted steel is made into a slab using a continuous casting process, the slab is made into a steel plate having a desired thickness by performing hot rolling, the hot-rolled steel plate is cooled, and a tempering treatment is performed thereafter. Regarding hot rolling, a slab heating temperature, a rolling reduction, a finishing temperature, a cooling rate after hot rolling has been performed, and a tempering temperature are specified.

Here, in embodiments, the temperature condition of a steel plate is specified in terms of the temperature of the central part of the steel plate, unless otherwise noted. The temperature of the central part in the thickness direction can be derived from, for example, the thickness, the surface temperature, and the cooling conditions using, for example, simulation calculation. For example, by calculating the temperature distribution in the thickness direction using a difference method, the temperature of the central portion in the thickness direction of the steel plate can be derived.

Slab heating temperature: 1030° C. or higher and 1200° C. or lower

The slab heating temperature is set to be 1030° C. or higher in order to certainly bond casting defects inside a slab by pressure by performing hot rolling. In addition, since there is a decrease in the toughness of a base metal and a weld zone due to an increase in the grain size of TiN which has been precipitated at the time of solidification in the case where the slab heating temperature is higher than 1200° C., the upper limit of the slab heating temperature is set to be 1200° C.

Cumulative rolling reduction of hot rolling in a temperature range of 950° C. or higher: 30% or more The cumulative rolling reduction of hot rolling in a temperature range of 950° C. or higher is set to be 30% or more in order to form a fine microstructure through the use of recrystallization of austenite grains. In the case where the cumulative rolling reduction described above is less than 30%, since abnormally large grains which are formed when heating is performed are retained, there is a negative effect on the toughness of a base metal.

Cumulative rolling reduction of hot rolling in a temperature range of lower than 950° C.: 30% or more and 70% or less Since austenite grains which are rolled in this temperature range do not recrystallize sufficiently, the austenite grains after hot rolling has been performed remain deformed in a flattened shape, and there is a large amount of internal strain including a large amount of defects such as a deformation zone. These defects function as a driving force of ferrite transformation so as to promote ferrite transformation.

However, in the case where the cumulative rolling reduction of hot rolling in a temperature range of lower than 950° C. is less than 30%, since there is insufficient accumulation of internal energy caused by internal strain, ferrite transformation is less likely to occur, which results in a decrease in the toughness of a base metal. On the other hand, in the case where the cumulative rolling reduction described above is more than 70%, since formation of polygonal ferrite is promoted, high strength and high toughness cannot be achieved at the same time.

Finishing temperature: 650° C. or higher and 790° C. or lower

It is preferable that the finishing temperature be 650° C. or higher in hot rolling, because sufficient strength and toughness of a base metal can be achieved. It is preferable that the finishing temperature be 790° C. or lower, because there is an increase in the toughness of a base metal. In particular, in embodiments, it is preferable that the finishing temperature be 700° C. or higher and 780° C. or lower.

Cooling rate down to a temperature of 600° C. or lower: 1.0° C./s or more

After hot rolling has been performed, accelerated cooling is performed down to an arbitrary temperature of 600° C. or lower at a cooling rate of 1.0° C./s or more. In the case where the cooling rate is less than 1° C./s, sufficient strength for a base metal cannot be achieved. In addition, in the case where cooling is stopped at a temperature higher than 600° C., since there is an increase in the fraction of a ferrite+pearlite structure (the total of a ferrite fraction (vol %) and a pearlite fraction (vol %)), high strength and high toughness cannot be achieved at the same time. In addition, in embodiments, it is preferable that a cooling stop temperature be lower than 280° C., because there is an increase in the strength of a base metal, more preferably 250° C. or lower in particular. Here, there is no limitation on the lower limit of the cooling stop temperature of accelerated cooling.

Tempering temperature: 450° C. or higher and 650° C. or lower

In the case where the tempering temperature is lower than 450° C., there is insufficient tempering effect. On the other hand, it is not preferable that the tempering temperature be higher than 650° C., because there is a decrease in toughness due to an increase in the grain diameters of carbonitride and Cu precipitations, and because there may be a decrease in strength. In addition, it is more preferable that tempering be performed using induction heating, because an increase in the grain diameter of carbides is prevented in the tempering. In order to realize this effect, the temperature of the central part of a steel plate which is calculated using simulation such as a difference method is controlled to be 450° C. or higher and 650° C. or lower.

In the case of the steel according to embodiments, since there is a decrease in the grain diameter of a microstructure in a heat-affected zone by suppressing an increase in the diameter of austenite grains in a heat-affected zone and by finely dispersing ferrite transformation nucleation sites which are not dissolved even at a high temperature, high toughness can be achieved. Also, in a region which is reheated in a temperature range in which a dual phase is formed due to a thermal history when multilayer welding is performed, since the grain diameter of a microstructure in a heat-affected zone is decreased by a first welding pass, there is an increase in the toughness of an untransformed region in the region reheated in a dual-phase temperature range, and there is a decrease in the diameter of retransformed austenite grains. Therefore, it is possible to decrease the degree of a decrease in toughness.

Examples

By preparing continuously cast slabs Nos. A to A1 having the chemical compositions given in Table 1, and by performing hot rolling and a heat treatment on the slabs, thick steel plates having a thickness of 50 to 100 mm were prepared.

In the case of slabs having a P content of 0.005% or less, the degree of segregation was purposefully decreased by performing light reduction rolling in a continuous casting process and by performing electromagnetic stirring on the downstream side of a continuous casting machine.

Microstructure observation was conducted on all the steel plates. The microstructures of the steel plates of the examples of disclosed embodiments mainly included 10 vol % or more of an acicular ferrite phase, 5 vol % or more and 50 vol % or less of a bainite phase, and 10 vol % or less of a polygonal ferrite phase. In the case of the microstructures of the comparative examples, one or more of an acicular ferrite fraction, a bainite fraction, and a polygonal ferrite fraction were out of the range according to embodiments.

A base metal was evaluated using yield stress (YP), tensile strength (TS), and absorbed energy at a temperature of −40° C., that is, $vE_{-40°\ C.}$ Yield stress (YP) and tensile strength (TS) were determined using a JIS No. 4 tensile test piece which was sampled from the position located at ½ of the thickness of the steel plate such that the longitudinal direction of the test piece is at a right angle to the rolling direction of the steel plate. In addition, absorbed energy at a temperature of −40° C., that is, $vE_{-40°\ C.}$ was determined by performing a Charpy impact test using a JIS V notch test piece which was sampled from the position located at ½ of the thickness of the steel plate such that the longitudinal direction of the test piece is at a right angle to the rolling direction of the steel plate. In the case where all the conditions YP≥420 MPa, TS≥520 MPa, and $vE_{-40°\ C.}$≥200 J were satisfied, base metal properties were evaluated as satisfactory.

The toughness of a weld zone was evaluated using absorbed energy at a temperature of −40° C., that is, $vE_{-40°\ C.}$ and a CTOD value at a temperature of −10° C., that is, $\delta_{-10°\ C.}$ Absorbed energy at a temperature of −40° C., that is, $vE_{-40°\ C.}$ was determined using a test piece which was sampled from a welded joint prepared by performing multilayer welding using submerged arc welding with a welding heat input of 45 to 50 kJ/cm using a K type groove so that a weld bond on the straight side located at ¼ of the thickness of the steel plate corresponded to a notch position of a Charpy impact test. In the case where the average value of three determined values of $vE_{-40°\ C.}$ satisfied the condition $vE_{-40°\ C.}$≥150 J, the toughness of the welded joint was evaluated as satisfactory. A CTOD value at a temperature of −10° C., that is, $\delta_{-10°\ C.}$ was determined using a test piece which was sampled so that a weld bond on the straight side corresponded to a notch position of a three-point bend CTOD test piece. In the case where the minimum value among CTOD values ($\delta_{-10°\ C.}$) for three test pieces was 0.70 mm or more, the CTOD property of the welded joint was evaluated as satisfactory.

The evaluation of the toughness of a weld zone (a Charpy impact test of a weld bond and a three-point bend CTOD test of a weld bond) was conducted on the steel plates whose base metal properties were evaluated as satisfactory with some exceptions.

Base metal properties, the results of the Charpy impact test, and the results of the CTOD test described above are given in Table 2 along with hot rolling conditions and heat treatment conditions.

Steel codes A to E are the examples of disclosed embodiments, and steel codes F to Z are comparative examples whose chemical composition regarding any of elements therein is out of the range according to embodiments. In the case of comparative example No. 32 where steel Al was used, although the chemical composition was in the range according to embodiments, relational expression $H_{Vmax}/H_{Vave} \geq 1.35+0.006/[C]-t/500$ was not satisfied. In the cases of No. 1, 2, 5, 6, 8, and 11 all of which were the examples of embodiments, and the results of a Charpy impact test of a weld bond and the results of a three-point bend CTOD test of a weld bond satisfied the objects.

On the other hand, in the case of comparative examples 3, 4, 7, 9, 10, and 12 to 32, the chemical compositions and/or the manufacturing conditions were out of the ranges according to embodiments, base metal properties, the results of a Charpy impact test of a weld bond, or the results of a three-point bend CTOD test did not satisfy the objects. In the case of comparative example No. 32 where steel A1 was used, where the chemical composition was in the range according to embodiments, and where relational expression $H_{Vmax}/H_{Vave} \leq 1.35+0.006/[C]-t/500$ was not satisfied, the results of a Charpy impact test of a weld bond and the results of a three-point bend CTOD test did not satisfy the objects.

TABLE 1

(mass %)

| Code | C | Si | Mn | P | S | Al | Cu | Ni | Nb | Ti | N | Cr | Mo |
|---|---|---|---|---|---|---|---|---|---|---|---|---|---|
| A | 0.062 | 0.08 | 1.57 | 0.004 | 0.0016 | 0.016 | 0.98 | 0.87 | 0.017 | 0.012 | 0.0035 | 0.23 | |
| B | 0.045 | 0.09 | 1.36 | 0.002 | 0.0015 | 0.014 | 0.94 | 0.64 | 0.029 | 0.009 | 0.0029 | | 0.15 |
| C | 0.035 | 0.20 | 1.53 | 0.003 | 0.0016 | 0.027 | 0.91 | 0.86 | 0.031 | 0.008 | 0.0032 | 0.31 | |
| D | 0.030 | 0.18 | 1.78 | 0.007 | 0.0015 | 0.021 | 1.07 | 0.89 | 0.015 | 0.009 | 0.0033 | | |
| E | 0.033 | 0.13 | 1.35 | 0.004 | 0.0018 | 0.039 | 0.92 | 0.53 | 0.027 | 0.011 | 0.0035 | 0.21 | |
| F | **0.097** | 0.18 | 1.45 | 0.002 | 0.0012 | 0.036 | 0.91 | 0.68 | 0.015 | 0.007 | 0.0023 | | |
| G | 0.066 | **0.44** | 1.33 | 0.006 | 0.0021 | 0.022 | 0.95 | 0.56 | 0.031 | 0.010 | 0.0037 | | |
| H | 0.035 | 0.12 | **1.07** | 0.002 | 0.0013 | 0.022 | 0.85 | 0.56 | 0.022 | 0.009 | 0.0026 | 0.19 | |
| I | 0.022 | 0.09 | **2.58** | 0.004 | 0.0018 | 0.021 | 0.84 | 0.75 | 0.017 | 0.008 | 0.0032 | | |
| J | 0.052 | 0.05 | 1.41 | **0.021** | 0.0015 | 0.029 | 0.97 | 1.13 | 0.017 | 0.008 | 0.0034 | | |
| K | 0.040 | 0.20 | 1.45 | 0.003 | 0.0018 | **0.089** | 1.04 | 0.69 | 0.025 | 0.007 | 0.0020 | | |
| L | 0.026 | 0.20 | 1.36 | 0.006 | 0.0024 | 0.040 | **0.58** | 0.56 | 0.019 | 0.008 | 0.0037 | 0.23 | |
| M | 0.074 | 0.09 | 1.59 | 0.006 | 0.0020 | 0.022 | **1.79** | 0.61 | 0.024 | 0.009 | 0.0035 | | |
| N | 0.040 | 0.14 | 1.68 | 0.003 | 0.0017 | 0.025 | 0.92 | 0.58 | **0.052** | 0.011 | 0.0033 | | |
| P | 0.060 | 0.19 | 1.61 | 0.006 | 0.0017 | 0.020 | 0.93 | 1.02 | 0.028 | **0.029** | 0.0029 | | |
| Q | 0.065 | 0.09 | 1.53 | 0.004 | 0.0007 | 0.013 | 1.10 | 1.45 | 0.023 | 0.013 | **0.0064** | | |
| R | 0.041 | 0.17 | 1.65 | 0.005 | 0.0021 | 0.012 | 1.04 | 1.46 | 0.013 | 0.008 | 0.0023 | **1.12** | |
| S | 0.034 | 0.05 | 1.47 | 0.005 | 0.0015 | 0.033 | 1.05 | 1.43 | 0.020 | 0.011 | 0.0033 | | **0.82** |
| T | 0.050 | 0.21 | 1.55 | 0.004 | 0.0011 | 0.012 | 1.01 | 0.66 | 0.029 | 0.008 | 0.0025 | | |
| U | 0.050 | 0.24 | 1.62 | 0.002 | 0.0008 | 0.027 | 1.14 | 0.74 | 0.027 | 0.010 | 0.0031 | | |
| V | 0.067 | 0.18 | 1.47 | 0.006 | 0.0009 | 0.031 | 1.06 | 1.26 | 0.017 | 0.008 | 0.0035 | | |
| W | 0.068 | 0.29 | 2.09 | 0.004 | 0.0020 | 0.023 | 1.01 | 1.41 | 0.014 | 0.007 | 0.0021 | 0.32 | 0.16 |
| X | 0.045 | 0.07 | 1.44 | 0.005 | 0.0026 | 0.021 | 0.90 | 1.13 | 0.014 | 0.006 | 0.0048 | | |
| Y | 0.070 | 0.23 | 1.58 | 0.004 | 0.0025 | 0.033 | 0.98 | 0.91 | 0.020 | 0.018 | 0.0022 | | |
| Z | 0.078 | 0.22 | 2.01 | 0.008 | 0.0019 | 0.017 | 1.11 | 0.99 | 0.032 | 0.011 | 0.0039 | | 0.32 |
| A1 | 0.074 | 0.24 | 1.51 | 0.004 | 0.0019 | 0.017 | 1.11 | 1.15 | 0.031 | 0.009 | 0.0027 | | |

| Code | V | Ca | O | Ceq (1) | Ti/N | Expression (2) | Expression (4) ACR | Note |
|---|---|---|---|---|---|---|---|---|
| A | | 0.0021 | 0.0017 | 0.493 | 3.43 | 2.74 | 0.66 | Example |
| B | | | 0.0010 | 0.407 | 3.10 | 2.84 | | Example |
| C | | 0.0011 | 0.0018 | 0.470 | 2.50 | 2.98 | 0.26 | Example |
| D | 0.015 | | 0.0012 | 0.460 | 2.73 | 2.83 | | Example |
| E | 0.017 | 0.0024 | 0.0015 | 0.400 | 3.14 | 2.69 | 0.74 | Example |
| F | | | 0.0012 | 0.445 | 3.04 | 2.63 | | Comparative Example |
| G | | 0.0014 | 0.0021 | 0.388 | 2.70 | 2.89 | 0.24 | Comparative Example |
| H | | | 0.0011 | 0.345 | 3.46 | 2.29 | | Comparative Example |
| I | | 0.0017 | 0.0021 | **0.558** | 2.50 | 3.54 | 0.38 | Comparative Example |
| J | | | 0.0013 | 0.427 | 2.35 | 2.86 | | Comparative Example |
| K | 0.026 | 0.0011 | 0.0013 | 0.402 | 3.50 | 2.76 | 0.30 | Comparative Example |
| L | | | 0.0024 | 0.375 | 2.16 | 2.51 | | Comparative Example |
| M | | | 0.0022 | 0.499 | 2.57 | 2.99 | | Comparative Example |
| N | | 0.0021 | 0.0011 | 0.420 | 3.33 | 2.57 | 0.75 | Comparative Example |
| P | | | 0.0014 | 0.458 | **10.00** | 3.11 | | Comparative Example |
| Q | | 0.0014 | 0.0020 | 0.490 | 2.03 | 2.95 | 0.77 | Comparative Example |
| R | | | 0.0024 | **0.707** | 3.48 | 2.71 | | Comparative Example |
| S | | | 0.0021 | **0.608** | 3.33 | 3.18 | | Comparative Example |
| T | **0.069** | | 0.0022 | 0.433 | 3.20 | 2.98 | | Comparative Example |
| U | | 0.0007 | 0.0032 | 0.445 | 3.23 | 2.98 | **−0.17** | Comparative Example |
| V | | 0.0032 | 0.0019 | 0.467 | 2.29 | 2.74 | **1.84** | Comparative Example |
| W | | | 0.0010 | **0.674** | 3.33 | 3.28 | | Comparative Example |
| X | | | 0.0014 | 0.420 | **1.25** | 2.53 | | Comparative Example |
| Y | | 0.0014 | 0.0024 | 0.459 | **8.18** | 2.87 | 0.17 | Comparative Example |
| Z | | | 0.0023 | **0.617** | 2.82 | **3.81** | | Comparative Example |
| A1 | | | 0.0017 | 0.476 | 3.33 | 3.12 | | Comparative Example |

Annotation 1 An underlined portion printed in bold indicates a value out of the range according to embodiments.

Annotation 2 Expression (1) . . . Ceq = [C] + [Mn]/6 + ([Cu]+ [Ni])/15 + ([Cr] + [Mo] + [V])/5

Annotation 3 Expression (2) . . . 5.5[C]4/3 + 15 [P] + 0.90[Mn] + 0.12[Ni] + 7.9[Nb]1/2 + 0.53[Mo]

Annotation 4 Expression (4) . . . {[Ca] − (0.18 + 130 × [Ca]) × [O]}/1.25/[S]

TABLE 2

| | | Rolling Condition | | | | | Cooling Condition | | |
|---|---|---|---|---|---|---|---|---|---|
| No. | Steel No. | Heating Temperature (° C.) | Cumulative Rolling Reduction at 950° C. or Higher (%) | Cumulative Rolling Reduction at Temperature below 950° C. (%) | Finishing Thickness (mm) | Finishing Temperature (° C.) | Cooling Rate (° C./s) | Cooling Stop Temperature (° C.) | Tempering Temperature (° C.) |
| 1 | A | 1039 | 50 | 50 | 75 | 780 | 5 | 220 | 560 |
| 2 | A | 1117 | 50 | 53 | 70 | 720 | 5 | 220 | 550 |
| 3 | A | **1235** | 62 | 56 | 50 | 760 | 10 | 260 | 580 |
| 4 | B | 1055 | **22** | **79** | 50 | 750 | 10 | 210 | 600 |
| 5 | B | 1073 | 40 | 44 | 100 | 700 | 2 | 110 | 590 |
| 6 | C | 1123 | 35 | 64 | 70 | 760 | 5 | 100 | 590 |
| 7 | C | 1052 | 30 | 31 | **150** | 730 | **0.8** | 160 | 560 |
| 8 | D | 1099 | 46 | 57 | 70 | 760 | 5 | 290 | 560 |
| 9 | D | 1042 | 38 | 62 | 70 | 790 | 5 | **620** | 550 |
| 10 | E | 1033 | 47 | 69 | 50 | 770 | 10 | 220 | **690** |
| 11 | E | 1118 | 48 | 68 | 50 | 790 | 10 | 250 | 590 |
| 12 | **F** | 1040 | 42 | 60 | 70 | 740 | 5 | 250 | 590 |
| 13 | **G** | 1047 | 50 | 53 | 70 | 760 | 5 | 450 | 645 |
| 14 | **H** | 1116 | 52 | 51 | 70 | 700 | 5 | 190 | 560 |
| 15 | **I** | 1090 | 47 | 56 | 70 | 760 | 5 | 140 | 610 |
| 16 | **J** | 1104 | 55 | 48 | 70 | 750 | 5 | 260 | 560 |
| 17 | **K** | 1042 | 49 | 67 | 50 | 790 | 10 | 220 | 570 |
| 18 | **L** | 1080 | 65 | 52 | 50 | 740 | 10 | 110 | 550 |
| 19 | **M** | 1072 | 64 | 54 | 50 | 740 | 10 | 190 | 560 |
| 20 | **N** | 1110 | 60 | 58 | 50 | 790 | 10 | 290 | 590 |
| 21 | **P** | 1088 | 39 | 45 | 100 | 780 | 2 | 130 | 560 |
| 22 | **Q** | 1031 | 46 | 38 | 100 | 730 | 2 | 150 | 590 |
| 23 | **R** | 1073 | 46 | 38 | 100 | 750 | 2 | 140 | 590 |
| 24 | **S** | 1036 | 48 | 55 | 70 | 750 | 5 | 220 | 570 |
| 25 | **T** | 1031 | 31 | 66 | 70 | 730 | 5 | 240 | 550 |
| 26 | **U** | 1127 | 37 | 63 | 70 | 710 | 5 | 200 | 600 |
| 27 | **V** | 1111 | 41 | 60 | 70 | 780 | 5 | 210 | 610 |
| 28 | **W** | 1041 | 40 | 61 | 70 | 780 | 5 | 100 | 600 |
| 29 | **X** | 1054 | 33 | 65 | 70 | 740 | 5 | 180 | 570 |
| 30 | **Y** | 1088 | 33 | 65 | 70 | 720 | 5 | 270 | 610 |
| 31 | **Z** | 1110 | 49 | 54 | 70 | 740 | 5 | 290 | 580 |
| 32 | **A1** | 1121 | 48 | 55 | 70 | 710 | 5 | 280 | 550 |

| | | Base Metal Property | | | | | Weld Zone Property | | |
|---|---|---|---|---|---|---|---|---|---|
| No. | Steel No. | YP (MPa) | TS (MPa) | vE −40° C. (J) | Left-hand Side of Expression (3) | Right-hand Side of Expression (3) | vE −40° C. (J) | CTOD δ −10° C. (mm) | Note |
| 1 | A | 524 | 624 | 227 | 1.25 | 1.30 | 178 | 1.350 | Example |
| 2 | A | 531 | 627 | 254 | 1.27 | 1.31 | 165 | 0.987 | Example |
| 3 | A | 541 | 639 | **46** | 1.26 | 1.35 | | | Comparative Example |
| 4 | B | **410** | 531 | **89** | 1.21 | 1.38 | | | Comparative Example |
| 5 | B | 533 | 617 | 205 | 1.22 | 1.28 | 165 | 0.846 | Example |
| 6 | C | 515 | 641 | 241 | 1.06 | 1.38 | 191 | 1.546 | Example |
| 7 | C | **408** | 556 | **35** | 1.14 | 1.22 | | | Comparative Example |
| 8 | D | 527 | 614 | 283 | 1.23 | 1.41 | 159 | 0.937 | Example |
| 9 | D | **375** | **508** | **142** | 1.26 | 1.41 | | | Comparative Example |
| 10 | E | **411** | 546 | 250 | 1.21 | 1.43 | | | Comparative Example |
| 11 | E | 510 | 618 | 264 | 1.20 | 1.43 | 165 | 1.356 | Example |
| 12 | **F** | 528 | 675 | **127** | **1.53** | 1.27 | **34** | **0.256** | Comparative Example |
| 13 | **G** | **401** | **471** | **148** | 1.13 | 1.30 | **29** | **0.125** | Comparative Example |
| 14 | **H** | **412** | 512 | 271 | 1.26 | 1.38 | | | Comparative Example |
| 15 | **I** | 541 | 627 | **49** | 1.45 | 1.48 | | | Comparative Example |
| 16 | **J** | 501 | 605 | 281 | 1.23 | 1.33 | **35** | **0.126** | Comparative Example |
| 17 | **K** | 546 | 659 | **128** | 1.03 | 1.40 | | | Comparative Example |
| 18 | **L** | **378** | **515** | 277 | 1.01 | 1.48 | | | Comparative Example |
| 19 | **M** | 588 | 693 | **110** | 1.05 | 1.33 | | | Comparative Example |
| 20 | **N** | 497 | 587 | 249 | 1.13 | 1.40 | **34** | **0.131** | Comparative Example |
| 21 | **P** | 503 | 587 | **61** | 1.13 | 1.25 | | | Comparative Example |
| 22 | **Q** | 522 | 633 | 235 | 1.04 | 1.24 | **46** | **0.137** | Comparative Example |
| 23 | **R** | 546 | 654 | 268 | 1.01 | 1.30 | **22** | **0.223** | Comparative Example |
| 24 | **S** | 593 | 704 | **78** | 1.06 | 1.39 | | | Comparative Example |
| 25 | **T** | 589 | 727 | **34** | 1.06 | 1.33 | | | Comparative Example |
| 26 | **U** | 534 | 648 | 233 | 1.04 | 1.33 | **56** | **0.235** | Comparative Example |
| 27 | **V** | 506 | 653 | 216 | 1.05 | 1.30 | **141** | **0.482** | Comparative Example |
| 28 | **W** | 574 | 755 | **56** | **1.45** | 1.30 | | | Comparative Example |
| 29 | **X** | 452 | 594 | 254 | 1.15 | 1.34 | **89** | **0.211** | Comparative Example |

TABLE 2-continued

| | | | | | | | | | |
|---|---|---|---|---|---|---|---|---|---|
| 30 | **Y** | 471 | 635 | 276 | 1.29 | 1.30 | **74** | **0.356** | Comparative Example |
| 31 | **Z** | 619 | 781 | **56** | **1.46** | 1.31 | **47** | **0.097** | Comparative Example |
| 32 | **A1** | 531 | 627 | 211 | **1.47** | 1.31 | **41** | **0.119** | Comparative Example |

Annotation 1 An underlined portion printed in bold indicates a value out of the range according to embodiments.
Annotation 2 Expression (3) . . . HVmax/HVave ≤1.35 + 0.006/[C] − t/500

The invention claimed is:

1. A thick-walled high-strength steel plate with an excellent low-temperature toughness property ("CTOD property") of a heat-affected zone, the steel plate having a chemical composition comprising:

C: 0.020% or more and 0.080% or less by mass %;
Si: 0.01% or more and 0.35% or less by mass %;
Mn: 1.20% or more and 2.30% or less by mass %;
P: 0.008% or less by mass %;
S: 0.0035% or less by mass %;
Al: 0.010% or more and 0.060% or less by mass %;
Cu: 0.70% or more and 1.50% or less by mass %;
Ni: 0.40% or more and 2.00% or less by mass %;
Nb: 0.005% or more and 0.040% or less by mass %;
Ti: 0.005% or more and 0.025% or less by mass %;
N: 0.0020% or more and 0.0050% or less by mass %;
O: 0.0030% or less by mass %; and
the balance being Fe and inevitable impurities, wherein (a) Ceq defined by the relational expression (1) is 0.520% or less, $$Ceq=[C]+[Mn]/6+([Cu]+[Ni])/15+([Cr]+[Mo]+[V])/5, \quad (1)$$

where [M] represents the content (mass %) of the chemical element represented by M, (b) Ti/N (mass ratio) is 1.50 or more and 4.00 or less, (c) relational expression (2) is satisfied, $$5.5[C]^{4/3}+15[P]+0.90[Mn]+0.12[Ni]+7.9[Nb]^{1/2}+0.53[Mo]\leq 3.50 \quad (2),$$

where [M] represents the content (mass %) of the chemical element represented by M, and (d) the hardness of a center segregation part satisfies relational expression (3)

$$H_{Vmax}/H_{Vave}\leq 1.35+0.006/[C]-t/500, \quad (3)$$

where $H_{Vmax}$ represents a maximum value of the Vickers hardness of a center segregation part, $H_{Vave}$ represents an average value of the Vickers hardness of portions other than portions within ¼ of a thickness from upper and lower surfaces of the steel plate and the center segregation part, [C] represents C content (mass %), and t represents the thickness of the steel plate (mm).

2. The thick-walled high-strength steel plate according to claim 1, the chemical composition further comprising at least one of the group (e) or (f), wherein (e) the chemical composition further comprising at least one of Cr: 0.10% or more and 1.00% or less by mass %, Mo: 0.05% or more and 0.50% or less by mass %, and V: 0.005% or more and 0.050% or less by mass %, and (f) Ca: 0.0005% or more and 0.0050% or less by mass %, wherein relational expression (4) is satisfied, $$0<\{[Ca]-(0.18+130\times[Ca])\times[O]\}/1.25/[S]<1.00, \quad (4)$$

where [M] represents the content (mass %) of the chemical element represented by M.

3. A method for manufacturing a thick-walled high-strength steel plate with an excellent CTOD property of a heat-affected zone, the method comprising:

heating steel having the chemical composition according to claim 1 at a temperature of 1030° C. or higher and 1200° C. or lower;

performing hot rolling on the heated steel such that the cumulative rolling reduction in a temperature range of 950° C. or higher is 30% or more and that the cumulative rolling reduction in a temperature range of lower than 950° C. is 30% or more and 70% or less;

performing accelerated cooling on the hot-rolled steel plate down to a temperature of 600° C. or lower at a cooling rate of 1.0° C./s or more; and performing a tempering treatment on the cooled steel plate at a temperature of 450° C. or higher and 650° C. or lower.

4. The thick-walled high-strength steel plate according to claim 1, wherein the steel plate has a yield stress of 420 MPa or more.

5. The thick-walled high-strength steel plate according to claim 1, wherein the steel plate has a tensile strength of 520 MPa or more.

6. The thick-walled high-strength steel plate according to claim 1, wherein the steel plate has a thickness in the range of 50 to 100 mm.

7. The thick-walled high-strength steel plate according to claim 1, wherein the steel plate exhibits an absorbed energy at a temperature of −40° C. ($vE_{-40°\ C.}$) of 200 J or more.

8. A method for manufacturing a thick-walled high-strength steel plate with an excellent CTOD property of a heat-affected zone, the method comprising:

heating steel having the chemical composition according to claim 2 at a temperature of 1030° C. or higher and 1200° C. or lower;

performing hot rolling on the heated steel such that the cumulative rolling reduction in a temperature range of 950° C. or higher is 30% or more and that the cumulative rolling reduction in a temperature range of lower than 950° C. is 30% or more and 70% or less;

performing accelerated cooling on the hot-rolled steel plate down to a temperature of 600° C. or lower at a cooling rate of 1.0° C./s or more; and performing a tempering treatment on the cooled steel plate at a temperature of 450° C. or higher and 650° C. or lower.

9. The thick-walled high-strength steel plate according to claim 2, wherein the steel plate has a yield stress of 420 MPa or more.

10. The thick-walled high-strength steel plate according to claim 2, wherein the steel plate has a tensile strength of 520 MPa or more.

11. The thick-walled high-strength steel plate according to claim 2, wherein the steel plate has a thickness in the range of 50 to 100 mm.

12. The thick-walled high-strength steel plate according to claim 2, wherein the steel plate exhibits an absorbed energy at a temperature of −40° C. ($vE_{-40°\ C.}$) of 200 J or more.

13. The thick-walled high-strength steel plate according to claim 1, wherein the chemical composition comprises Cu: 0.80% or more and 1.50% or less by mass %.

14. The thick-walled high-strength steel plate according to claim 2, wherein the chemical composition comprises Cu: 0.80% or more and 1.50% or less by mass %.

* * * * *